US005771489A

United States Patent [19]

Snedeker

[11] Patent Number: 5,771,489

[45] Date of Patent: Jun. 30, 1998

[54] PENETRATION-RESISTANT HINGE AND FLEXIBLE ARMOR INCORPORATING SAME

[75] Inventor: Richard Snedeker, Cranbury, N.J.

[73] Assignee: Titan Corporation, San Diego, Calif.

[21] Appl. No.: 746,488

[22] Filed: Nov. 12, 1996

[51] Int. Cl.[6] ..... F41H 1/02

[52] U.S. Cl. ..... 2/12.5

[58] Field of Search ..... 2/2.5, 455; 403/65, 403/66, 68, 70, 73, 75, 79, 119; 16/362, 363, 360

[56] References Cited

U.S. PATENT DOCUMENTS

| | | |
|---|---|---|
| 4,198,707 | 4/1980 | Haupt et al. . |
| 4,483,020 | 11/1984 | Dunn . |
| 4,633,528 | 1/1987 | Brandt . |
| 4,680,812 | 7/1987 | Weigl . |
| 4,879,165 | 11/1989 | Smith . |
| 4,989,266 | 2/1991 | Borgese et al. . |
| 5,132,167 | 7/1992 | Prato . |
| 5,180,880 | 1/1993 | Zufle . |
| 5,316,820 | 5/1994 | Harpell et al. . |
| 5,327,811 | 7/1994 | Price et al. . |
| 5,364,679 | 11/1994 | Groves . |
| 5,443,882 | 8/1995 | Park . |

*Primary Examiner*—C. D. Crowder
*Assistant Examiner*—Larry D. Worrell, Jr.
*Attorney, Agent, or Firm*—Larson & Taylor

[57] ABSTRACT

A flexible body armor which is relatively lightweight and capable of biaxial flexure is disclosed. The flexible body armor employs a novel penetration-resistant hinge for joining adjacent armor plates along one axis and uses sliding overlaps between the same adjacent armor plates along the perpendicular axis in order to achieve biaxial flexibility. Also disclosed are several embodiments of the penetration-resistant hinge and the sliding overlap. In a preferred body armor in accordance with the invention the penetration-resistant hinges and sliding overlaps are part of a frame which provides edge confinement to ceramic armor plates used in the body armor.

18 Claims, 5 Drawing Sheets

PENETRATION-RESISTANT HINGE AND FLEXIBLE ARMOR INCORPORATING SAME

BACKGROUND OF THE INVENTION

1. Field of the Invention

The present invention relates to a penetration-resistant hinge and a flexible armor design which incorporates one or more penetration-resistant hinges. The present invention provides a flexible armor which has a high degree of penetration resistance.

2. Description of the Prior Art

The need for flexibility in armor and especially body armor is frequently cited as a major concern of armor designers and users alike. Current flexible body armor technology relies primarily on multiple plies of fabric in the form of a vest. To this may be added, in limited areas, a rigid plate of metal, ceramic or composite if higher levels of threat are anticipated.

Fabric vests are typically capable of stopping threats up to National Institute of Justice (hereinafter "NIJ") Level III-A (pistol and light rifle bullets). The rigid add-on plates, which are usually carried in one or more fabric pockets, are required to stop threats such as NIJ Levels III and IV (heavier rifle and light machine gun bullets, including armor piercing bullets). Vests including rigid add-on plates can be very restrictive and uncomfortable when worn, since their flexibility is limited to the fabric areas which are not covered by the rigid add-on plates. In addition, the add-on plates used with fabric vests are often very heavy and thick. Due to these shortcomings, numerous ideas have been proposed in order to achieve a high degree of flexibility and penetration resistance in body armor without adding significant weight or bulk to the armor. However, to date none of these have proven entirely satisfactory, and very few of these concepts have actually been successfully employed.

Existing flexible body armor technology falls into two general categories. First, multiple plies of flexible material such as woven fabric, unidirectional fibers or plastic sheeting have been used in various combinations. Second, platelets, elements or other segments of rigid material such as metal and/or ceramic material have been bonded to, or contained in, a carrier of flexible material. Body armor designs based on multiple plies of flexible material have not been used successfully for threats of NIJ Level III or greater. The number of plies of such materials which would be required to stop such threats would have little or no flexibility and would be very bulky and heavy.

Designs using platelets or elements of rigid materials have also been less than satisfactory for threats of NIJ Level III and greater. Most of the designs which have been employed are limited to lower levels of threat due to weight and bulk considerations. Other designs suffer from inherent vulnerability at the segment joints. Nearly all of the designs rely on a fabric carrier to provide the flexibility needed to allow movement between adjacent rigid segments.

Vulnerability at the joints has been addressed in several ways, including overlapping of segment edges or interfitting of mating edge shapes. However, none of the designs have provided a satisfactory balance between weight, flexibility and penetration resistance.

These solutions suffer from additional problems. For example, use of add-on segments made of ordinary armor steel requires additional weight per unit area (areal density) of approximately 9 lbm/ft$^2$, for a Level III threat, which is more than twice the weight per unit area of some lightweight body armor systems. For lightweight ceramic materials, the overlapping edges of complex interfitting shapes used to join such segments have been found to be detrimental since the free edges of ceramic materials are easily fractured on impact and thus, in practice, offer little resistance to penetration. Even if the most efficient ceramic is employed in a fabric carrier without rigid support, the areal density required to stop a typical Level III threat such as the M80 bullet is still about 8 lbm/ft$^2$, or nearly twice that of the lightest one-piece rigid add-on plate. Further, even these systems have limited flexibility.

In addition, a problem that is fundamental to the use of fabric pockets is that there is no mechanical connection between adjacent rigid add-on plates. By itself, the fabric has too little strength to hold the segments in place during impact at such a joint, thereby resulting in vulnerability at the joint.

An example of the use of a plurality of rigid plates in overlapping relationship in a protective garment is given in U.S. Pat. No. 4,680,812 (Weigl). This reference does not relate to a body armor for resisting penetration by bullets. The plates are employed in an elongate array extending along the spinal column or other body area to be protected. The plates are pivotally interconnected by joints which allow a limited relative rotation between the plates as well as limited longitudinal movement between the plates so that the armor structure can conform to body changes during normal movements. Overextension is prevented by abutment of the plates against each other, thereby limiting or preventing potentially harmful movement of the protected body portions.

An example of a bullet-deflecting body armor is given in U.S. Pat. No. 4,633,528 (Brandt). This armor employs pairs of rigid plates with angled surfaces abutting each other, which plates can be enclosed in pockets formed in a flexible material in order to provide a sheet of protective material. A plurality of pairs of the plates can be arranged in overlapping pockets in rows and columns in order to form a protective vest or coat.

U.S. Pat. No. 4,198,707 (Haupt, et al) discloses a soft protective construction for body protection such as a bullet-proof vest or shirt. A double-layered bullet-stopping arrangement of mutually movable rectangular or square protective plates is provided. The plates of the outer layer are made of armor material sufficient in itself to stop the bullet. They are preferably inserted into pockets of a flexible carrier material and are overlapped in a scale-like fashion. The plates of the inner layer are made of soft shock-absorbing plastic material or the like and are arranged in a common plane and are joined together in a form-locked manner along the horizontally oriented edges by slide joints and along the vertically oriented edges by rotating joints.

In one embodiment shown in FIG. 5 of Haupt, the adjacent pieces of shock-absorbing material are joined by a press-stud type fastening. This is intended to make it easier to arrange the plates with relatively greater mobility in the pockets because in contrast to the rotating joint shown in FIG. 4, this snap-fastening affords a forced-key joint between the adjacent plates. The only flexibility of such a joint is due to the softness of the material from which it is made and the loose fit of the mating parts. Further, neither the shock-absorbing plastic material nor the press-stud joint provide penetration resistance to the armor.

U.S. Pat. No. 4,483,020 (Dunn) discloses a vest having projectile-stopping capabilities. The vest includes a network of inner shock-resistant plates lying under a layer of ballistic material. The shock resistant plates are sewn or interlocked together to form a single impact-resisting unit. Each plate includes two outwardly projecting tabs and two recessed openings which are constructed to fit such that corresponding adjacent plates can be flexed outwardly to conform to the user's body configuration while at the same time resisting inward flexing.

Each of these body armor systems suffers from one or more disadvantages in weight per unit area, penetration resistance at the joints, bulkiness and/or lack of flexibility. Accordingly, there is a need in the art for an improved penetration-resistant hinge for use in armor and, most advantageously for use to fabricate flexible body armor which is lightweight, sufficiently flexible and can resist severe threats of NIJ Level III or greater at all points, including joints.

SUMMARY OF THE INVENTION

In a first aspect, the present invention relates to a penetration-resistant hinge for joining adjacent armor plates which is useful in flexible armor. The hinge includes a first face having a central cylindrical spline, a first mating surface located along one side of the spline and a second mating surface located along the other side of the spline. The hinge also includes a second face which is provided with a central cylindrical cut-out shaped to receive the cylindrical spline and having edges which extend a sufficient distance around the spline to securely radially retain the spline in the cut-out. The second face also includes a first mating surface located along one side of the cut-out and a second mating surface located along the other side of the cut-out.

The hinge is further characterized by the fact that at least one of the mating surfaces of the first and second faces is inclined with respect to the other of the mating surfaces on the same face. As a result, when the spline is axially slid into the cut-out, only one of the first and second mating surfaces on the first face mates with the corresponding mating surface on the second face when the hinge is in a first, closed position. When the hinge is in a second, open position, only the other of the mating surfaces on the first face mates with the corresponding mating surface on the second face.

In a second aspect, the present invention relates to a flexible armor which includes at least two armor plates and at least one penetration-resistant hinge as described above, joining the armor plates along at least one edge of the plates.

In a third aspect, the present invention relates to a flexible armor which is capable of biaxial flexure. Such armor includes at least four armor plates, each of which is joined to at least one other armor plate by a penetration-resistant hinge as described above. This embodiment is further characterized by including at least two adjacent armor plates that are provided with overlapping edges that form a sliding overlap between the plates. By virtue of the sliding overlap acting in combination with the hinges, this armor is capable of biaxial flexure.

In a more preferred aspect of the present invention, the penetration-resistant hinge forms part of a frame around plates of armor which are made from ceramic material or other lightweight rigid armor. The hinge not only provides flexibility to a rigid ceramic armor, but its embodiment in the form of a frame also provides confinement of the edges of the ceramic plates in order to increase the penetration resistance along these edges.

The present invention provides armor which is flexible, relatively light and has a high degree of penetration resistance. This type of flexible armor is particularly suitable for use as flexible body armor which is usable either by itself (stand-alone) or as a supplement to an underlying soft armor garment (add-on). These and other objects of the present invention will be apparent from the detailed description which follows.

DETAILED DESCRIPTION OF THE PREFERRED EMBODIMENTS

In the specification, like elements are indicated by like numerals throughout the several views.

Figure 1:
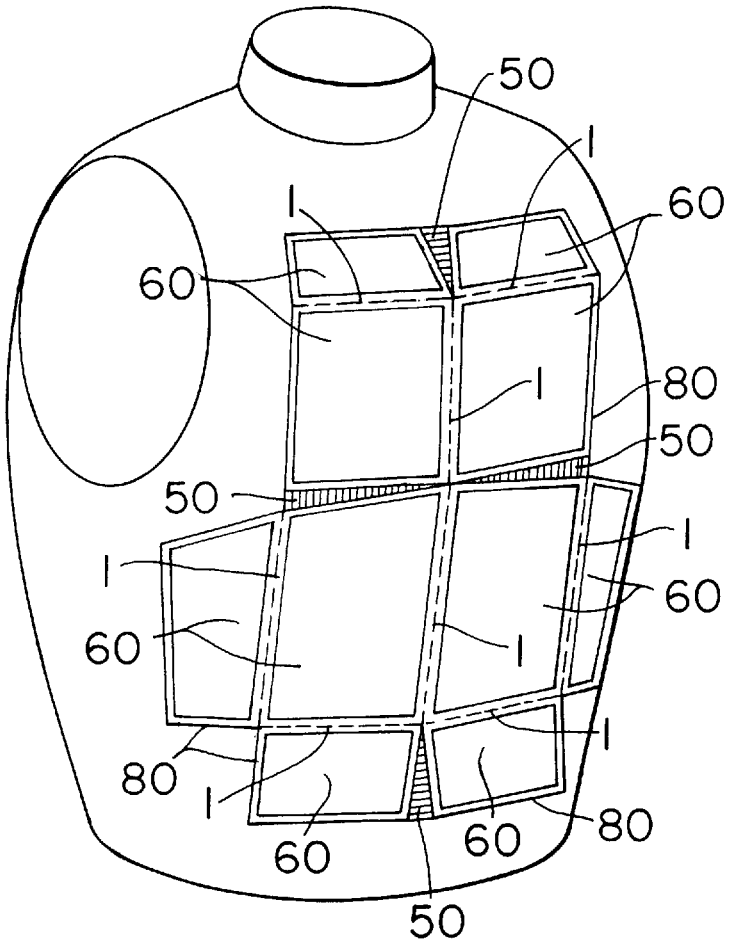
FIG. 1 is a perspective view of a preferred embodiment of a flexible body armor in accordance with the present invention.

In FIG. 1 there is shown a schematic representation of a body armor including the penetration-resistant hinge of the present invention. The body armor of FIG. 1 includes ten distinct armor plates 60 which are attached to one another by penetration-resistant hinges 1 and sliding overlaps 50. Also shown in FIG. 1 are frames 80 which enclose the outer edges of, and provide edge confinement to the armor plates 60 which make up the body armor.

Figure 2:
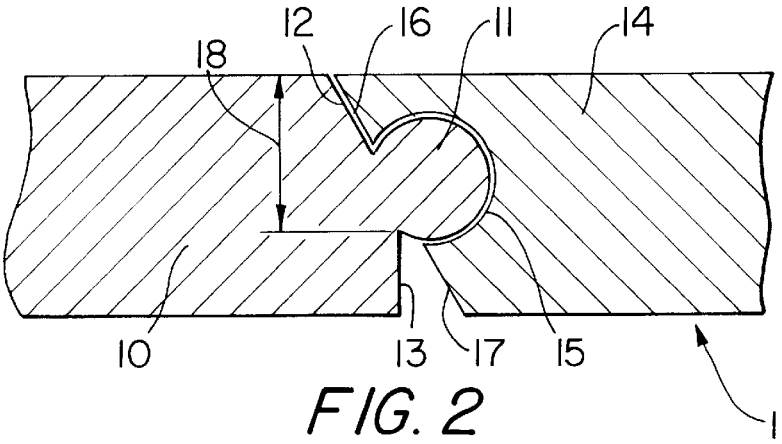
FIG. 2 is a cross-sectional view of a first embodiment of a penetration-resistant hinge in accordance with the present invention with the hinge in the closed position.

A preferred embodiment of the penetration-resistant hinge 1 of the present invention is depicted in FIG. 2. Hinge 1 includes a first face 10 provided with a central, cylindrical spline 11, a first mating surface 12 and a second mating surface 13. Hinge 1 also includes a second face 14 which is provided with a central cut-out 15 that is shaped to receive cylindrical spline 11 of first face 10. Second face 14 is also provided with a first mating surface 16 and a second mating surface 17.

Figure 3:
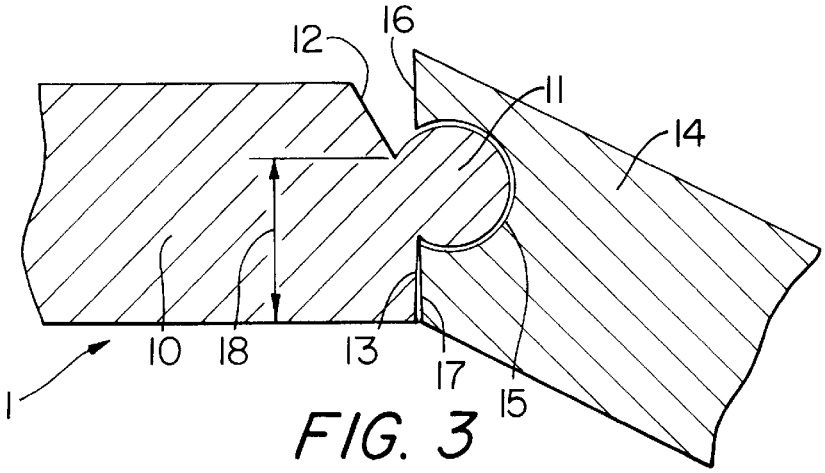
FIG. 3 is a cross-sectional view of the hinge of FIG. 2 in the open position.

Hinge 1 is designed to have a minimum cross-sectional thickness as shown by 18 which is a predetermined minimum thickness of a given material for stopping the level of threat for which the body armor is designed. Hinge 1 of FIG. 2 is shown in the closed position wherein mating surface 12 of first face 10 abuts with mating surface 16 of second face 14. In this position, a combination of a portion of second face 14 in the vicinity of mating surface 16 and the cylindrical spline 11 together form a section which is at least the minimum thickness 18 required to stop the level of threat. When hinge 1 of FIG. 2 is flexed to the open position (as shown in FIG. 3), mating surface 16 of second face 14 will move away from mating surface 12 of first face 10. At the same time, mating surface 17 of second face 14 will move closer to mating surface 13 of first face 10 until mating surface 17 abuts with mating surface 13 when hinge 1 is in the fully open position. In this position, the minimum cross section to resist penetration 18 is made up of a combination of the cylindrical spline 11 and a portion of the first face 10 adjacent to mating surface 13.

Mating surface 12 of first face 10 is inclined with respect to mating surface 13 of first face 10. In this manner, room is provided between mating surface 13 and mating surface 17 so that the hinge 1 can rotate from the fully closed position as shown in FIG. 2 to the fully open position as shown in FIG. 3. A second function of the relative inclination of the mating surfaces 12, 13 is to ensure that when hinge 1 is in intermediate positions between the fully open and fully closed position as a result of partial flexure of the body armor, that there is a minimum level of exposure of the reduced cross section of hinge L to an incoming projectile.

Thus, when hinge 1 is half open, there will be a slight space between mating surface 12 and mating surface 16 as well as a slight space between mating surface 13 and mating surfaces 12, 16. However, for a projectile to enter the space between mating surface 12 and mating surface 16, it would have to impinge upon hinge 1 at an angle due to the inclination of mating surfaces 12, 16. Further, even if the projectile does impinge on hinge 1 at the correct angle, hinge 1 still provides adequate protection in the half-open position since the space between mating surface 12 and mating surface 16 is not large enough to permit passage of the projectile. For example, an M80 (a typical Level-III threat) bullet is significantly larger than the space which would open between mating surface 12 and mating surface 16 when hinge 1 is in the half-open position. Thus, hinge 1 still provides adequate protection even in the half-open position.

Only the region near hinge 1 must have a thickness greater than the minimum thickness 18 required to stop the threat in order to preserve the minimum thickness 18 when hinge 1 is in either the open or closed position. Away from hinge 1, the thickness of the armor plate can be the minimum. This leads to a significant weight savings for body armor having metal frame plates as in FIG. 1 or an all metal armor plating having the hinges formed integrally with the armor plate.

Useful materials for forming the penetration-resistant hinge 1 of the present invention are materials that have sufficient strength and ductility to resist brittle fracture, or other types of mechanical failure in normal use. As a result, metals are the preferred materials. Some high strength composites could be used to fabricate the hinge of the present invention although they are less preferred due to their low density and generally low ballistic space efficiency which would likely require a hinge 1 of larger than desired cross section and thickness. Examples of materials from which the hinge 1 of the present invention may be made are high hardness steel, rolled armor steel, titanium and aluminum. Hinge 1 may be fabricated by any conventional means such as casting or electric discharge machining.

The penetration-resistant hinge 1 may be employed with either side facing the oncoming threat. The orientation of the hinge 1 will depend on the desired direction of flexure. The range of flexure of the hinge can be increased or decreased by changing the relative inclination of mating surfaces 12, 13, 16, 17. Care must be taken, however, not to weaken the cross-section of the hinge 1 or to expose too large an area of a reduced cross-section of the hinge 1 to a particular trajectory.

Figure 4:
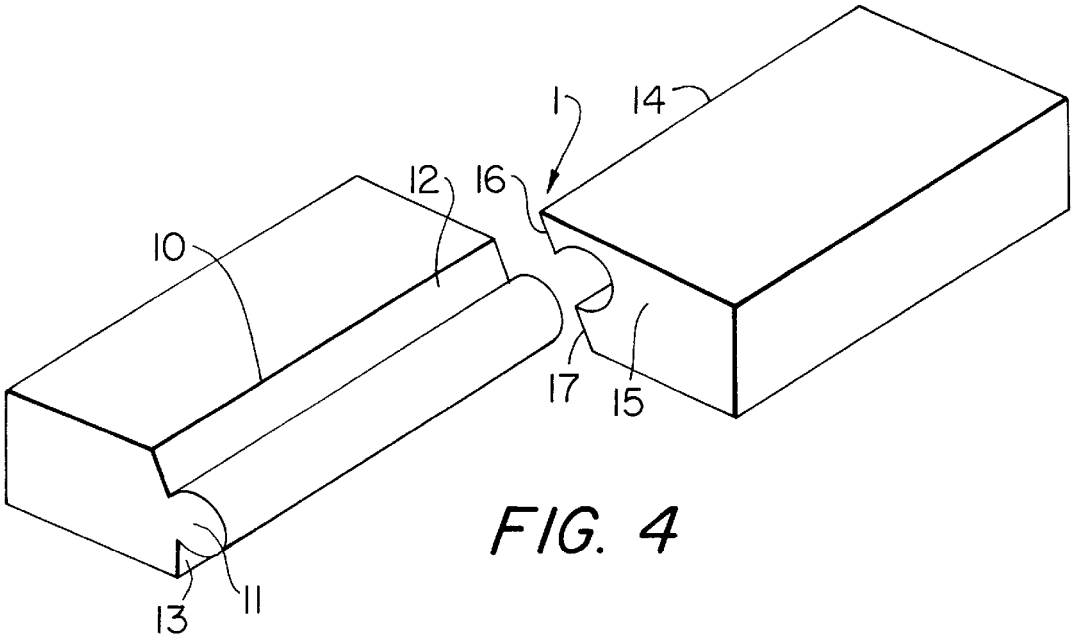
FIG. 4 is a perspective view of a disassembled penetration-resistant hinge in accordance with the present invention showing how the hinge is assembled.

Referring now to FIG. 4, there is shown hinge 1 in accordance with the present invention in disassembled condition. In order to assemble hinge 1, first face 10 and second face 14 are aligned substantially as shown in FIG. 4 Then, first face 10 and second face 14 are moved laterally with respect to one another while inserting cylindrical spline 11 into central cut-out 15 such that mating surface 12 abuts with mating surface 16 when hinge 1 is in the closed position. Also shown in FIG. 4 are mating surfaces 13 and 17 which are spaced apart when hinge 1 is in the closed position and which abut with one another when hinge 1 is in the open position.

Figure 5A:
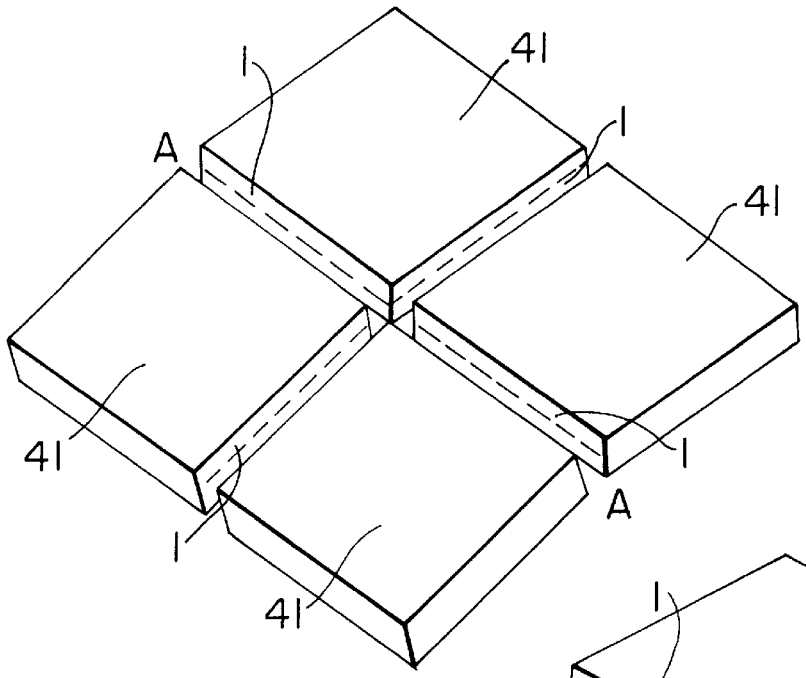
FIG. 5A is a perspective view of four hinged armor segments showing uniaxial flexure along the line A—A.
Figure 5B:
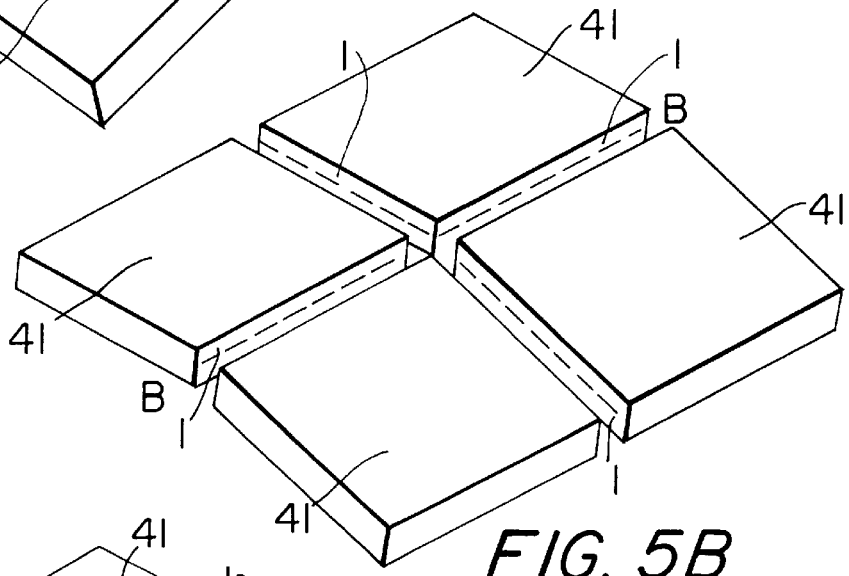
FIG. 5B is a perspective view of four hinged armor segments showing a uniaxial flexure along the line B—B.

The use of penetration-resistant hinges 1 on all of the mating edges of the armor plates in a body armor permits uniaxial flexure of the body armor as shown in FIGS. 5A and 15B, where the hinges 1 are depicted by dashed lines. In particular, the armor of FIG. 5A is flexed along the line A—A by virtue of all the joints between armor plates 41 being penetration-resistant hinges 1. In FIG. 5B the armor is flexed along line B—B. With only penetration-resistant hinges 1 to join plates 41, these two forms of uniaxial flexure are possible. In some cases, however, it is desirable to join armor plates in a manner which permits biaxial flexure of the armor. Biaxial flexure allows the body armor to more closely approximate the natural contours of the human torso.

Figure 5C:
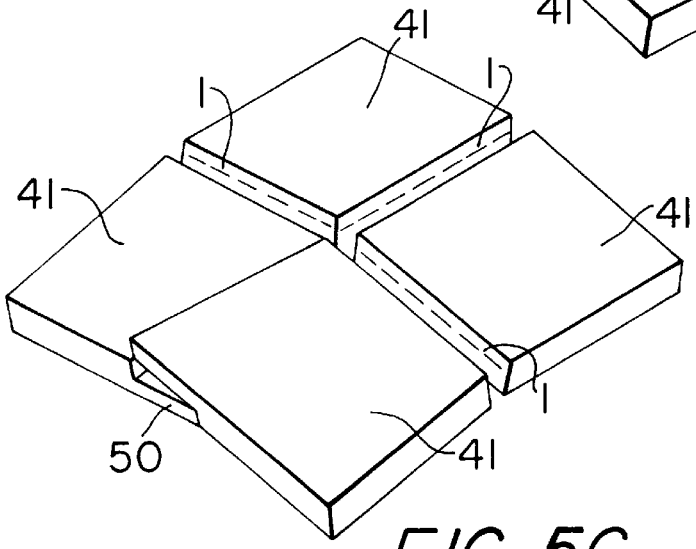
FIG. 5C is a perspective view of four armor segments with three hinges and one sliding overlap showing biaxial flexure.

Thus, with the same four segments joined along one axis by penetration-resistant hinges 1 and partially along the other axis by sliding overlaps 50 as shown in FIG. 5C, it is possible to obtain biaxial flexure of the armor since the plates joined by a sliding overlap 50 are not connected and therefore are free to slide across each other and flex as the hinges 1 between the other segments are flexed. As a result, the armor of FIG. 5C which employs a combination of hinges 1 and sliding overlaps 50 is capable of biaxial flexure. This provides increased flexibility of the armor and allows the armor to better approximate the contour of the torso.

Figure 6:
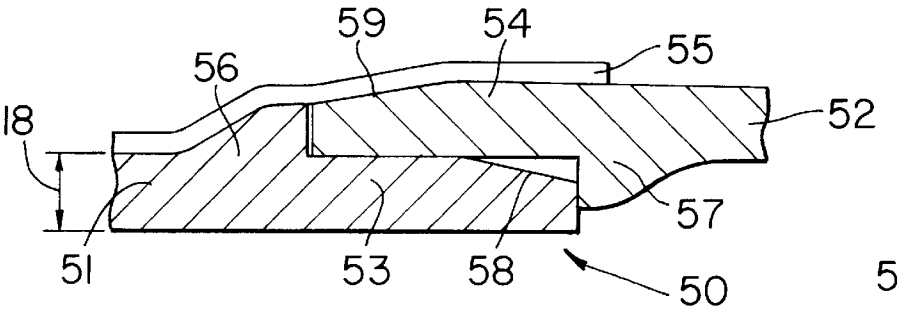
FIG. 6 is a cross-sectional view of an embodiment of a sliding overlap between two armor plates in the unflexed and compressed position.

FIG. 6 is a cross-sectional view of the details of a sliding overlap 50 as shown in FIG. 5C. Armor plates 51, 52 are provided with overlapping edges 53, 54, respectively, which together form sliding overlap 50.

When all of the armor plates 41 lie in a flat plane, there are lateral gaps between the overlapping edges 53, 54 of the sliding overlap 50 and the sliding overlap 50 is in the unflexed, extended position. If the flexible armor is biaxially flexed as in FIG. 5C the lateral gaps disappear and the sliding overlap 50 is in the flexed and compressed position. When the armor plates 41 are flexed uniaxially the sliding overlap 50 is in the flexed, extended position.

Figure 7:
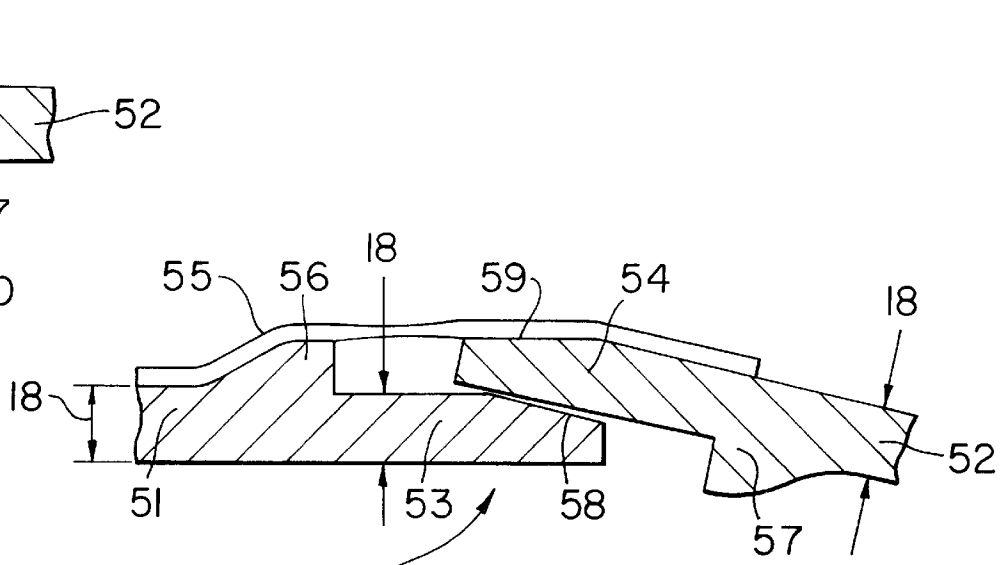
FIG. 7 is a cross-sectional view of the sliding overlap shown in FIG. 6 in the flexed and extended position.

The thickness 18 of each of the overlapping edges must be sufficient to stop a projectile in and of itself since as shown in FIG. 7, when the sliding overlap 50 is in the extended position, a portion of each overlapping edge 53, 54 is not overlapped by a portion of the other plate. As a result, when sliding overlap 50 is extended, a portion of one overlapping edge 53 will be directly exposed to the impact of an incoming projectile without the added protection of overlapping edge 54 as in the unflexed position of FIG. 6.

Only the region at the inner edge of each of the overlapping edges 53, 54 must have a thickness equal to or greater than the minimum thickness 18. Away from this region the thickness can be the minimum as is shown in FIGS. 6 and 7. The sections of greater thickness 56, 57 are included for the purpose of limiting the relative sliding movement of the armor plates.

The sliding overlap 50 may also be made to accommodate unflexed positions of the armor plates other than flat (i.e. as above in FIG. 3 where the surfaces of adjacent armor plates are not in the same plane) in a manner similar to the manner employed for the penetration-resistant hinge 30 depicted in FIG. 3.

Optionally, sliding overlap 50 may be restrained by an elastic material 55 which is attached to armor plates 51, 52 by any suitable means such as adhesive bonding, fasteners, etc. Elastic material 55 is shown in the unflexed and compressed position in FIG. 6. The elastic material 55 is an example of one means to bias overlapping edges 53, 54 into the position shown in FIG. 6 which provides maximum protection for the armor wearer.

Flexure of the flexible armor can also be accommodated by the elastic material 55 as shown in FIG. 7. In particular, FIG. 7 shows the sliding overlap 50 in the flexed and extended position. The elasticity of elastic material 55 allows sliding overlap 50 to flex upon application of sufficient force to the armor by the wearer of the armor plating.

Each of the armor plates 51, 52 may include, as part of sliding overlap 50, sections of increased thickness 56, 57. These sections of increased thickness 56, 57 act as stops which limit the relative movement of armor plates 51, 52 with respect to each other.

In the most preferred embodiment of sliding overlap 50, each of the overlapping edges 53, 54 are beveled as indicated by reference numerals 58, 59. The extent of the beveling is limited by the need to maintain at least the minimum thickness 18 for protection through both plates for all positions. Beveling of overlapping edges 53, 54 reduces the out-of-plane protrusion of the overlapping edge 54 of the top sliding plate 52 during flexure as is shown in FIG. 7.

Figure 8:
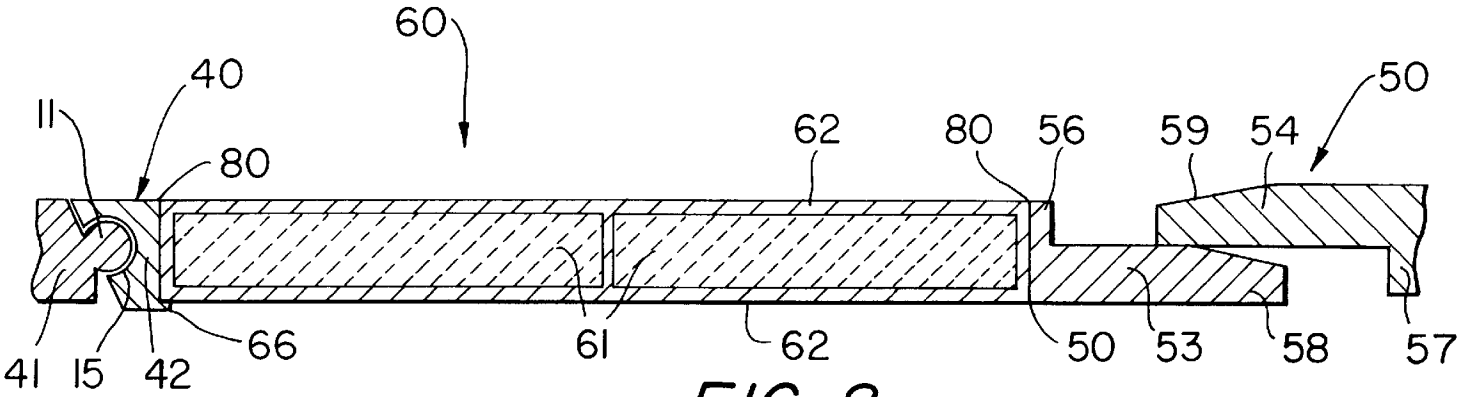
FIG. 8 is a cross-sectional view of an armor plate having a penetration-resistant hinge along one edge, a sliding overlap along a second edge, and a central region containing a lightweight armor material such as ceramic composite.

Referring now to FIG. 8, there is shown a cross section of a preferred embodiment of an armor plate 60 in accordance with the present invention. Armor plate 60 is formed from two ceramic segments 61 sandwiched between layers of a lightweight composite 62 and surrounded by a frame 80, one side of which is a second face 42 of a penetration-resistant hinge 40 and the opposite side of which is a sliding overlap 50 having a first overlapping edge 53 which is beveled at 58. Also shown in FIG. 7 are a first face 41 of penetration-resistant hinge 40 attached to a contiguous armor plate (not shown), and a second overlapping edge 54 which is attached to another contiguous armor plate (not shown). Overlapping edge 54 is also beveled at 59 in order to minimize the out of plane protrusion of overlapping edge 54 as the armor plates slide across one another at sliding overlap 50. Sliding overlap 50 further includes sections of increased thickness 56, 57 which act as stops to limit the relative movement of overlapping edges 53, 54, and also serve to confine the armor plate material 61 and 62.

Second face 42 of penetration-resistant hinge 40 and first overlapping edge 53 of sliding overlap 50 may be attached to armor plate 60 by any suitable means such as adhesive, by a sawtooth joint or by a beveled joint, for example. Any means for attaching the armor plate 60 to second face 42 of penetration-resistant hinge 40 and/or first overlapping edge 53 of sliding overlap 50 is acceptable so long as the strength and weight of the armor are not adversely affected. The penetration-resistant hinge 40 preferably forms one or more edges of a frame surrounding the armor plate material. FIG. 8 illustrates this by showing a section through one of the plates also shown in FIG. 1. If armor plate 60 is made from metal, it is also possible, and often desirable, to form second face 42 of penetration-resistant hinge 40 and/or first overlapping edge 53 of sliding overlap 50 integrally with armor plate 60.

In order to enhance edge confinement of armor plate 60, penetration-resistant hinge 40 may optionally include a lip 66 which overlaps slightly with armor plate 60 in order to confine the edge of armor plate 60. Confining the edge of ceramic materials may be important since ceramic materials tend to fracture more easily at the edges, thereby reducing the penetration resistance provided by such ceramic plates. It has been found that edge confinement reduces the tendency of such plates to fracture at the edges, thereby enhancing the level of penetration resistance provided by the edges of such plates.

There are several methods for the fabrication of frame 80, casting and electric discharge machining are preferred. Frame 80 may be attached to the composite armor plate 60 by adhesive bonding using epoxy or another high strength adhesive which is compatible with the materials. Mechanical attachment can be effectuated by a sawtooth or beveled joint between frame 80 and armor plate 60. The design of said joint should be such that penetration resistance is retained should an impact occur on said joint.

Figure 9:
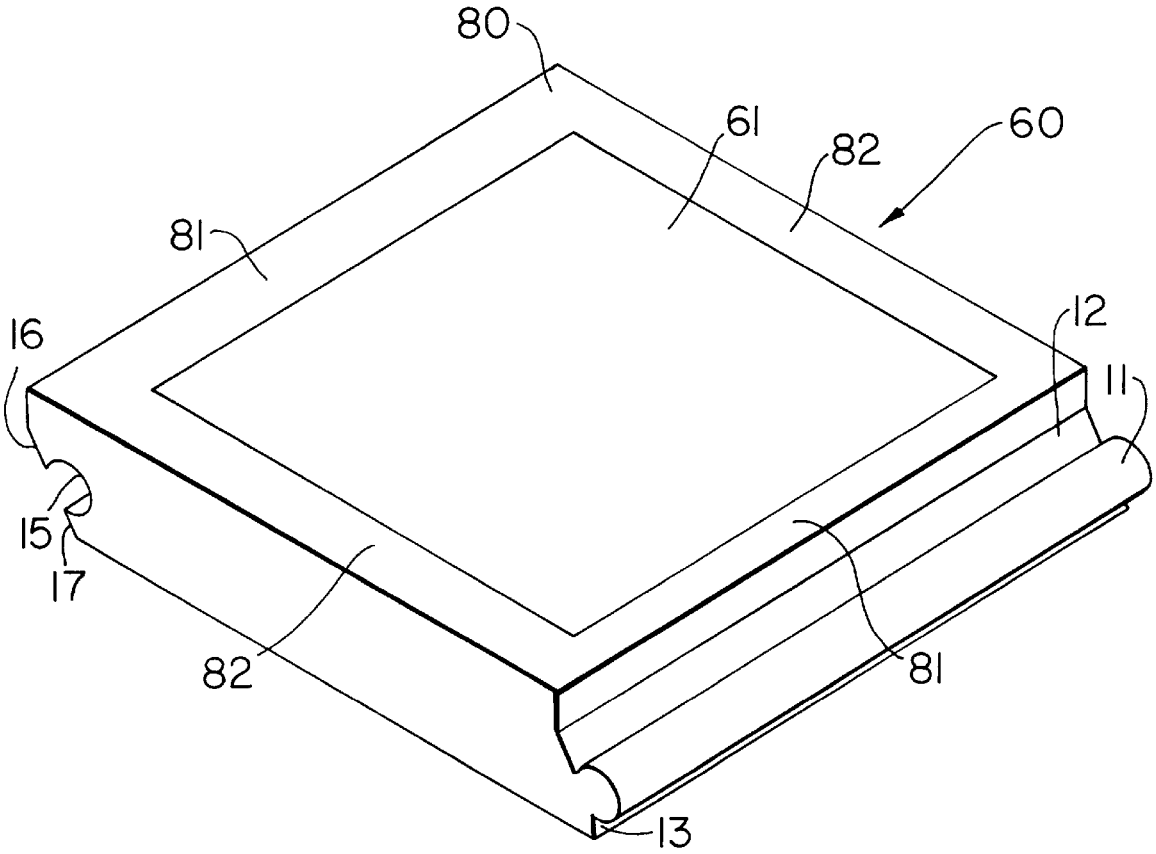
FIG. 9 is a perspective view of another embodiment of an armor plate with penetration-resistant hinges along two edges of the plate.

In FIG. 9 another embodiment of an armor plate of the invention is shown in perspective view. The plate of FIG. 9 has one ceramic segment 61 and penetration resistant hinges 1 along two side edges. In this embodiment, the frame 80 and the ceramic segment 61 are of the same thickness.

The relative thickness of the hinged and unhinged edges of the frame 80 and the central armor plate 61 are chosen to maximize safety and minimize weight. The thickness of the hinged frame edges 81 is determined by the minimum thickness 18 of the material used to fabricate the hinge which is required to stop the level of threat. On the other hand, the thickness of the unhinged frame edges 82 is determined partly by the type of material used on the level of threat and partly by the material used for the central armor plate 61. When central armor plate 61 is a ceramic material, frame edges 82 should be sufficiently thick to confine the edges of central armor plate 61 to thereby improve its penetration resistance. However, for some plastic composite materials it is possible to use a thinner, lighter frame edge 82 since such materials may not require a high degree of edge confinement. The width of the sides of the frame is determined by a combination of ballistic, structural strength and weight considerations.

Figure 10:
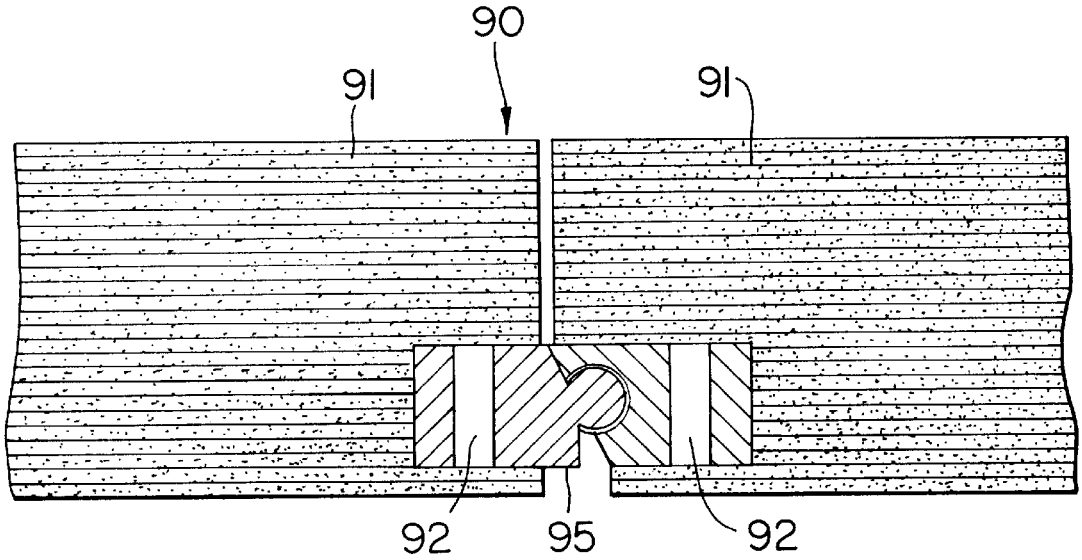
FIG. 10 is a cross-sectional view of two armor plates made from a soft composite material which are joined along one edge by a penetration-resistant hinge in accordance with the present invention.
Figure 9:
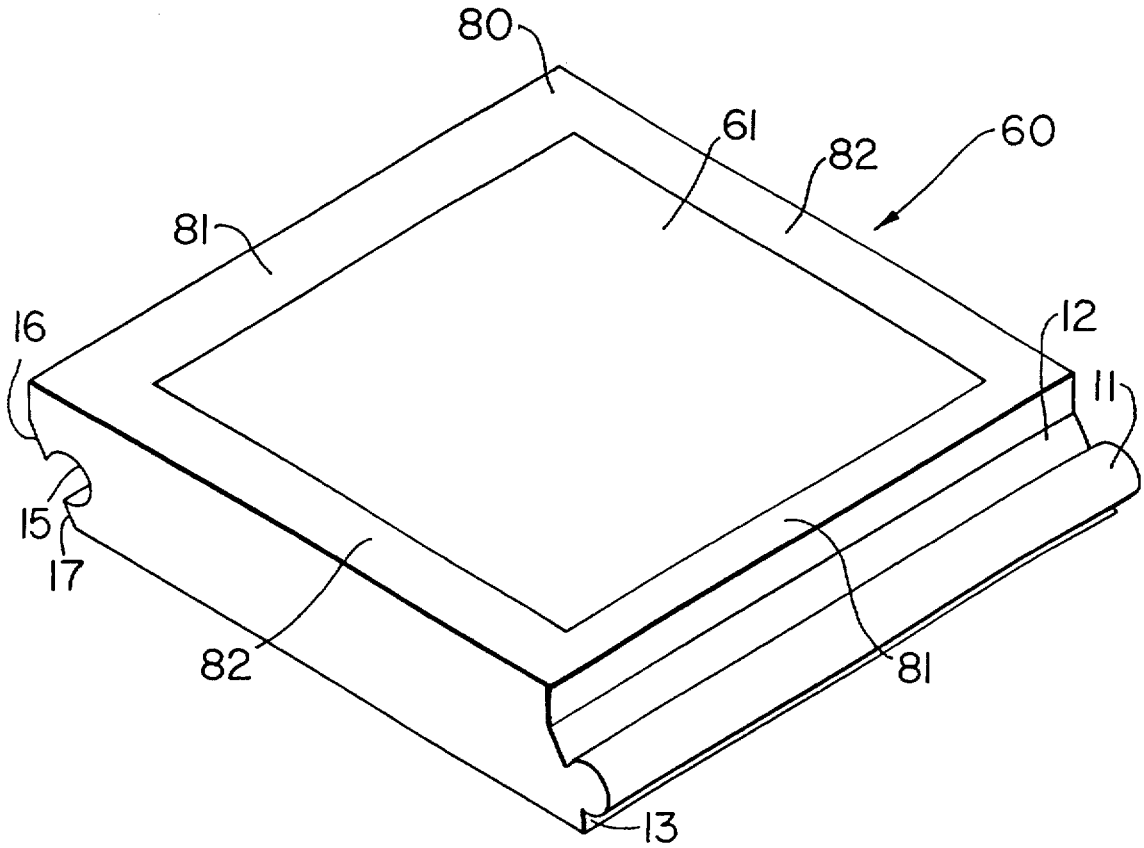
Figure 10:
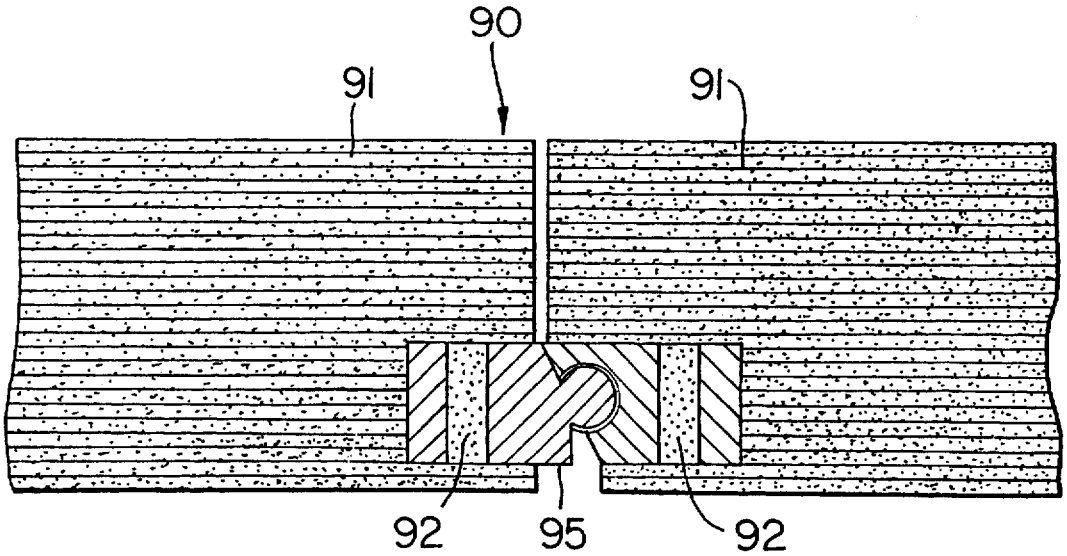

The penetration-resistant hinge 95, for example, may also be used to join thick, relatively soft composites, such as Spectra Shield®, by embedding the penetration-resistant hinge 95 in place during fabrication of the composite. As shown in FIG. 10, the resin 91 used to hold the plies together in such a composite armor 90 may also be employed to fill holes 92 in the hinge 95 in order to anchor it in place. Additional Spectra® fibers may also be passed through holes 92 and then embedded in the resin of the Spectra Shield® on both sides. This will further enhance the anchoring. Since Spectra Shield® does not resist penetration very well close to its edges, the penetration-resistant hinge 95 can provide additional protection in this critical area as shown in FIG. 10.

The invention is further illustrated by the following example.

EXAMPLE

Eighty-three percent of the total area of the add-on body armor of FIG. 1 may be fabricated from a lightweight ceramic composite system weighing 4.5 lbm/ft$^2$ housed in steel frames fitted along adjoining edges with penetration-resistant hinges or sliding overlaps according to the present invention. The frames thus constitute only seventeen percent of the area. The total estimated weight of the add-on shown is 9.2 lbs. Since the add-on covers approximately 1.43 ft$^2$, the average areal density is about 6.4 lbm/ft$^2$. This flexible add-on can be compared with a rigid one made up entirely of the same ceramic composite system. The rigid add-on having the same area will weigh 6.4 lbs. Thus, the cost in weight for biaxial flexibility when employing the present invention is only about 2.8 lbs. spread over an area of 1.43 ft$^2$.

The foregoing detailed description of the invention has been provided for the purpose of illustration and description only and is not to be construed as limiting the invention in any way. The scope of the invention is to be determined from the claims appended hereto.

I claim:

1. A penetration-resistant hinge for joining adjacent armor plates which is useful in flexible body armor, said hinge comprising a first part having a first face and a second part having a second face:

one of said first and second faces having a central, cylindrical spline, a first mating surface located along one side of said spline, and a second mating surface located along the other side of said spline;

the other of said first and second faces including an elongate, central cut-out shaped to receive and closely fit with said cylindrical spline to substantially prevent movement of said first and second faces away from one another, and having edges which extend a sufficient distance around said spline to securely radially retain said spline in said cut-out, a first mating surface located along one side of said cut-out, and a second mating surface located along the other side of said cut-out; and wherein the first mating surface of said first face is inclined away from the corresponding mating surface on the second face relative to the second mating surface of said first face such that when said spline is axially slid into said cut-out, only the first mating surface of said first face mates with the corresponding first mating surface of said second face when the hinge is in a first, closed position and because of said inclination of at least one mating surface of the first face, the second mating surface of said first face is spaced from the second mating surface of the second face by a distance sufficient to permit the desired degree of flexibility of the hinge by rotation of the central cut-out about the central axis of the cylindrical spline between the first, closed position and a second, open position wherein the second mating surface of the first face mates with the second mating surface of said second face and in the open position the first mating surface of the first face is spaced from the first mating surface of the second face.

2. A penetration-resistant hinge as claimed in claim 1 wherein the thickness of the hinge through its minimum cross section in both the first, closed position and the second, open position is greater than or equal to a predetermined minimum thickness.

3. A penetration-resistant hinge as claimed in claim 2 wherein the cylindrical spline is sufficiently large to provide structural integrity to the adjacent armor plates without employing an additional supporting means.

4. Flexible body armor which comprises at least two armor plates each having at least one edge and at least one penetration-resistant hinge joining said armor plates along at least one edge of said plates, said hinge comprising:

first and second faces, one of said first and second faces having a central, cylindrical spline, a first mating surface located along one side of said spline, and a second mating surface located along the other side of said spline;

the other of said first and second faces including an elongate, central cut-out shaped to receive and closely fit with said cylindrical spline to substantially prevent movement of said first and second faces away from one another, and having edges which extend a sufficient distance around said spline to securely radially retain said spline in said cut-out, a first mating surface located along one side of said cut-out, and a second mating surface located along the other side of said cut-out; and wherein the first mating surface of said first face is inclined away from the corresponding mating surface on the second face relative to the second mating surface of said first face such that when said spline is axially slid into said cut-out, only the first mating surface of said first face mates with the corresponding first mating surface of said second face when the hinge is in a first, closed position and because of said inclination of at least one mating surface of the first face, the second mating surface of said first face is spaced from the second mating surface of the second face by a distance sufficient to permit the desired degree of flexibility of the hinge by rotation of the central cut-out about the central axis of the cylindrical spline between the first, closed position and a second, open position wherein the second mating surface of the first face mates with the second mating surface of said second face and in the open position the first mating surface of the first face is spaced from the first mating surface of the second face.

5. Flexible body armor according to claim 4 wherein the thickness of the hinge through its minimum cross section in both the first, closed position and the second, open position is greater than or equal to a predetermined minimum thickness.

6. Flexible body armor according to claim 5 wherein the cylindrical spline is sufficiently large to provide structural integrity to the adjacent armor plates without employing an additional supporting means.

7. Flexible body armor according to claim 4 that is capable of biaxial flexure and which comprises at least four armor plates each of which is joined to at least one other armor plate by at least one penetration-resistant hinge and wherein at least two adjacent armor plates include overlapping edges which form at least one sliding overlap between said at least two armor plates when said at least four armor plates are joined together by said penetration-resistant hinges.

8. Flexible body armor as claimed in claim 7 wherein at least one of said overlapping edges of said armor plates which form said sliding overlap comprises a section of greater thickness than the remaining portion of said at least one overlapping edge, which section of greater thickness acts to limit the sliding motion of the two armor plates relative to one another.

9. Flexible body armor as claimed in claim 8 wherein the overlapping edges of said at least two adjacent armor plates include an inner surface and an outer surface and wherein at least one of said inner and outer surfaces of said overlapping edges is beveled.

10. Flexible body armor as claimed in claim 9 further comprising a layer of elastic material bonded to said at least two adjacent armor plates over said sliding overlap.

11. Flexible body armor as claimed in claim 7 wherein said armor plates have a longitudinal axis and a lateral axis and said at least one penetration-resistant hinge joins said four armor plates along one of the longitudinal and lateral axes and wherein at least two of said four armor plates overlap along the other of said axes by said at least one sliding overlap.

12. Flexible body armor as claimed in claim 11 which comprises at least five armor plates and wherein each of said fifth and succeeding armor plates is joined to one of said first four armor plates by a penetration-resistant hinge.

13. Flexible body armor as claimed in claim 12 wherein at least two of said fifth and succeeding armor plates are joined to adjacent of said first four armor plates and which further comprises at least one sliding overlap between said adjacent two of said fifth and succeeding armor plates.

14. Flexible body armor as claimed in claim 4 wherein said penetration-resistant hinges are made from a material selected from steel and titanium and said armor plates comprise at least one ceramic material.

15. Flexible body armor as claimed in claim 14 wherein said at least one penetration-resistant hinge forms part of a frame which extends along at least one edge of said armor plates.

16. Flexible body armor as claimed in claim 15 wherein said frame further comprises a means for providing edge confinement to at least one of the edges of said armor plates along which said frame extends.

17. Flexible body armor as claimed in claim 16 wherein said means for providing edge confinement comprises a lip which forms a seat for the at least one edge of said armor plate.

18. Flexible body armor as claimed in claim 17 wherein at least one of said armor plates comprises a plurality of ceramic segments sandwiched between two layers of a composite material.

* * * * *

UNITED STATES PATENT AND TRADEMARK OFFICE

CERTIFICATE OF CORRECTION

PATENT NO. : 5,771,489

DATED : June 30, 1998

INVENTOR(S) : SNEDEKER

It is certified that error appears in the above-indentified patent and that said Letters Patent is hereby corrected as shown below:

In the drawings on Sheet 5 of 5, elements 92 should be stippled as shown on the attached copy of this sheet.

Signed and Sealed this

Eighth Day of December, 1998

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,771,489
DATED : June 30, 1998
INVENTOR(S) : Snedeker, Richard

It is certified that error appears in the above-identified patent and that said Letters Patent is hereby corrected as shown below:

Column 1,
Line 4, please add the following section to the beginning of the specification above the heading "BACKGROUND OF THE INVENTION":

-- STATEMENT REGARDING FEDERALLY SPONSORED RESEARCH

This invention was made with Government support under Contract No. DAAK60-95-C-2039 awarded by U.S. Army Soldier Systems Command. The Government has certain rights in this invention. --

Signed and Sealed this

Fourth Day of June, 2002

*Attest:*

*Attesting Officer*

JAMES E. ROGAN
*Director of the United States Patent and Trademark Office*